US005454656A

United States Patent [19]

Rowe

[11] Patent Number: 5,454,656

[45] Date of Patent: Oct. 3, 1995

[54] PAINT PAD ASSEMBLIES WITH A PUMP SUPPLIED RESERVOIR

[76] Inventor: Richard A. Rowe, 448 Locust St., Coshocton, Ohio 43812

[21] Appl. No.: 236,648

[22] Filed: May 2, 1994

[51] Int. Cl.[6] ..... B05C 17/005; B05C 17/01; B05C 17/00

[52] U.S. Cl. ..... 401/146; 401/149; 401/151; 401/188 R; 401/204; 401/207; 401/266

[58] Field of Search ..... 401/146, 149, 401/150, 188 R, 203, 204, 205, 207, 151, 266

[56] References Cited

U.S. PATENT DOCUMENTS

| | | | |
|---|---|---|---|
| 1,598,742 | 9/1926 | Parker | 401/203 X |
| 3,020,579 | 2/1962 | O'Connor | 401/188 R |
| 4,971,471 | 11/1990 | Sloan | 401/203 |

FOREIGN PATENT DOCUMENTS

| | | | |
|---|---|---|---|
| 206310 | 4/1959 | Austria | 401/149 |
| 1090590 | 3/1955 | France | 401/207 |
| 881035 | 6/1953 | Germany | 401/204 |

*Primary Examiner*—Steven A. Bratlie

[57] ABSTRACT

A paint pad assembly with a pump supplied reservoir comprises a reservoir formed as a generally rectangular shaped box with a vertical back plate, a vertical front plate and four side plates therebetween. One of the side plates includes an aperture. The front plate include coupling means to permit releasable coupling with the side plates. The front plate includes a plurality of long generally rectangular shaped apertures to permit the free flow of paint therethrough. Two upwardly extending brackets are separated by a small distance. Each bracket has an aperture which includes coupling means. The brackets are positioned on the back face of the reservoir. A hose is comprised of flexible materials and formed in a long hollow, tubular configuration with two free ends. One end of the hose is coupled to the reservoir through the aperture in the side wall and the other free end is coupled to a paint supply. A handle is formed as an elongated hollow, tubular member with an open end at its lowermost extent. The handle includes an aperture near its uppermost extent, with a circular hole positioned a short distance below the aperture. The handle is coupled to the brackets on the reservoir through the aligned apertures. The hose is positioned through the open end in the lowermost extent and circular hole near the uppermost extent. The hollow interior of the extension handle houses the hose therebetween.

5 Claims, 4 Drawing Sheets

PAINT PAD ASSEMBLIES WITH A PUMP SUPPLIED RESERVOIR

BACKGROUND OF THE INVENTION

1. Field of the Invention

The present invention relates to paint pad assemblies with a pump supplied reservoir and more particularly pertains to applying controlled quantities of paint to walls and ceilings by pumping paint to the reservoir of the apparatus.

2. Description of the Prior Art

The use of paint applicators is known in the prior art. More specifically, paint applicators heretofore devised and utilized for the purpose of applying paint to various surfaces are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,737,187 to Pryor an angularly controlled extension for house painter's brush.

U.S. Pat. No. 4,611,941 to Karliner discloses a pressurized paint pad mounting.

U.S. Pat. No. 4,219,899 to Zurawin discloses a paint pad assembly.

U.S. Pat. No. 5,000,602 to Kim discloses a paint applicator.

Lastly, U.S. Pat. No. 5,007,753 to England discloses a window cleaning apparatus with rotatable head.

In this respect, the paint pad assemblies with a pump supplied reservoir according to the present invention substantially depart from the conventional concepts and designs of the prior art, and in doing so provides an apparatus primarily developed for the purpose of applying controlled quantities of paint to walls and ceilings by pumping paint to the reservoir of the apparatus.

Therefore, it can be appreciated that there exists a continuing need for new and improved paint pad assemblies with a pump supplied reservoir which can be used for applying controlled quantities of paint to walls and ceilings by pumping paint to the reservoir of the apparatus. In this regard, the present invention substantially fulfills this need.

SUMMARY OF THE INVENTION

In view of the foregoing disadvantages inherent in the known types of paint applicators now present in the prior art, the present invention provides an improved paint pad assembly with a pump supplied reservoir. As such, the general purpose of the present invention, which will be described subsequently in greater detail, is to provide a new and improved paint pad assembly with a pump supplied reservoir and method which has all the advantages of the prior art and none of the disadvantages.

To attain this, the present invention essentially comprises a new and improved paint pad assembly with a pump supplied reservoir. The apparatus includes a reservoir formed as a generally rectangular shaped box with a small vertical back plate, a large vertical front plate and four slanted pyramid shaped side plates connecting the back and front plates therebetween. All of the plates have an internal surface and an external surface. The reservoir has a circular aperture with internal screw threads positioned slightly below the midpoint of one of the side plates. The back plate includes coupling means which extend through the plate at its approximate center point. The four side edges of the front plate include coupling means to permit releasable coupling with the lower extents of the side plates. The outer perimeter of all four sides of the front plate extend a small distance outward from the intersection point of the front and side plates. The front plate includes a plurality of long generally rectangular shaped apertures throughout its surface to permit the free flow of paint therethrough. The reservoir includes a rubber gasket formed as a generally rectangular shaped band. The gasket is affixed around the side edges of the external surface of the front plate of the reservoir. The gasket is adapted to help prevent leakage of paint. A steel screen is formed in a generally planar rectangular configuration with a plurality of small circular holes throughout its surface. The screen includes coupling means around its periphery to permit coupling to the front plate. The screen is adapted to allow the free flow of paint therethrough and onto a desired recipient surface. A mounting brace has an upper region and a lower region. The lower region is formed as a generally planar semi circular shaped plate with a rounded end and a linear end. A long semi circular shaped aperture is positioned near the rounded portion of the plate and follows its contour. The plate is affixed to the outer surface of the back plate by coupling means located at the center point of the plate to permit circular rotation thereabout. The back plate includes a screw which extends upwardly through the semi circular aperture. A wing nut is cooperatively coupled to the screw to hold the plate securely in place, while also permitting alternative positioning of the plate by swiveling it about the aperture. The upper region of the brace includes two oppositely opposed, upwardly extending, generally semi circular shaped members positioned perpendicular to the linear end of the plate. The members are separated by a small distance and include centrally located circular holes at their approximate center points. A submergible pump includes an intake pipe for the receipt of paint, an output pipe for the distribution of paint, and an electrically powered motor positioned therebetween. The pump includes a foot pedal positioned outside of the paint supply. The pedal is coupled to the motor by an electrical wire. The pedal is adapted to permit a user to regulate the flow of paint distributed by the pump by depressing the pedal. The flow of paint is terminated upon release of the pedal by the user. The pump is adapted to be submerged in a supply of paint in the operative orientation. A hose is comprised of flexible materials and formed in a long hollow, tubular configuration with two free ends. The hose is cooperatively coupled with a cap formed in a generally solid cylindrical configuration. The cap includes internal screw threads and a planar circular top section. The cap has a centrally located circular hole which extends therethrough. One free end of the hose is affixed within the hole in the cap. The cap is coupled within the circular aperture in the side plate of the reservoir. The other free end of the hose is coupled to the output pipe of the submergible pump which is positionable in a supply of paint in the operative orientation. An extension handle has an upper segment and a lower segment. The upper segment is formed as an elongated hollow tubular member with an open end at its lowermost extent. A cylindrical collar with internal screw threads is positioned a short distance below the open end. The collar is adapted to allow movement of the upper segment through the opening in the collar. The upper segment includes a generally planar semi circular piece at its uppermost extent. The piece includes a centrally located screw hole and is adapted to be positioned between the upwardly extending members of the mounting brace. A bolt and wing nut are adapted to couple the upper segment of the handle to the members through their aligned screw holes. The upper segment also includes a circular hole near its uppermost extent. The lower segment is formed as an elongated hollow tubular member with a larger circumference than the upper segment. The lower segment has an open end at its lowermost extent, with the uppermost extent including an open end and external screw threads. The uppermost extent of the lower segment is adapted to be releasably coupled with the collar of the upper segment. The lower segment is also adapted to receive the upper segment and lock the handle to the desired length upon twisting. The hose is positioned through the open end in the lowermost extent of the lower segment and circular hole in the upper segment. The hollow interior of the extension handle houses the hose therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved paint pad assemblies with a pump supplied reservoir which have all the advantages of the prior art paint applicators and none of the disadvantages.

It is another object of the present invention to provide new and improved paint pad assemblies with a pump supplied reservoir which may be easily and efficiently manufactured and marketed.

It is further object of the present invention to provide new and improved paint pad assemblies with a pump supplied reservoir which are of durable and reliable constructions.

An even further object of the present invention is to provide new and improved paint pad assemblies with a pump supplied reservoir which are susceptible of a low cost of manufacture with regard to both materials and labor, and which accordingly are then susceptible of low prices of sale to the consuming public, thereby making such paint pad assemblies with a pump supplied reservoir economically available to the buying public.

Still yet another object of the present invention is to provide new and improved paint pad assemblies with a pump supplied reservoir which provide in the apparatuses and methods of the prior art some of the advantages thereof, while simultaneously overcoming some of the disadvantages normally associated therewith.

Still another object of the present invention is to apply controlled quantities of paint to walls and ceilings by pumping paint to the reservoir of the apparatus.

Lastly, it is an object of the present invention to provide new and improved paint pad assemblies with a pump supplied reservoir comprising a reservoir formed as a generally rectangular shaped box with a vertical back plate, a vertical front plate and four side plates therebetween. One of the side plates includes an aperture. The front plate include coupling means to permit releasable coupling with the side plates. The front plate includes a plurality of long generally rectangular shaped apertures to permit the free flow of paint therethrough. Two upwardly extending brackets are separated by a small distance. Each bracket has an aperture which includes coupling means. The brackets are positioned on the back face of the reservoir. A hose is comprised of flexible materials and formed in a long hollow, tubular configuration with two free ends. One end of the hose is coupled to the reservoir through the aperture in the side wall and the other free end is coupled to a paint supply. A handle is formed as an elongated hollow, tubular member with an open end at its lowermost extent. The handle includes an aperture near its uppermost extent, with a circular hole positioned a short distance below the aperture. The handle is coupled to the brackets on the reservoir through the aligned apertures. The hose is positioned through the open end in the lowermost extent and circular hole near the Uppermost extent. The hollow interior of the extension handle houses the hose therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
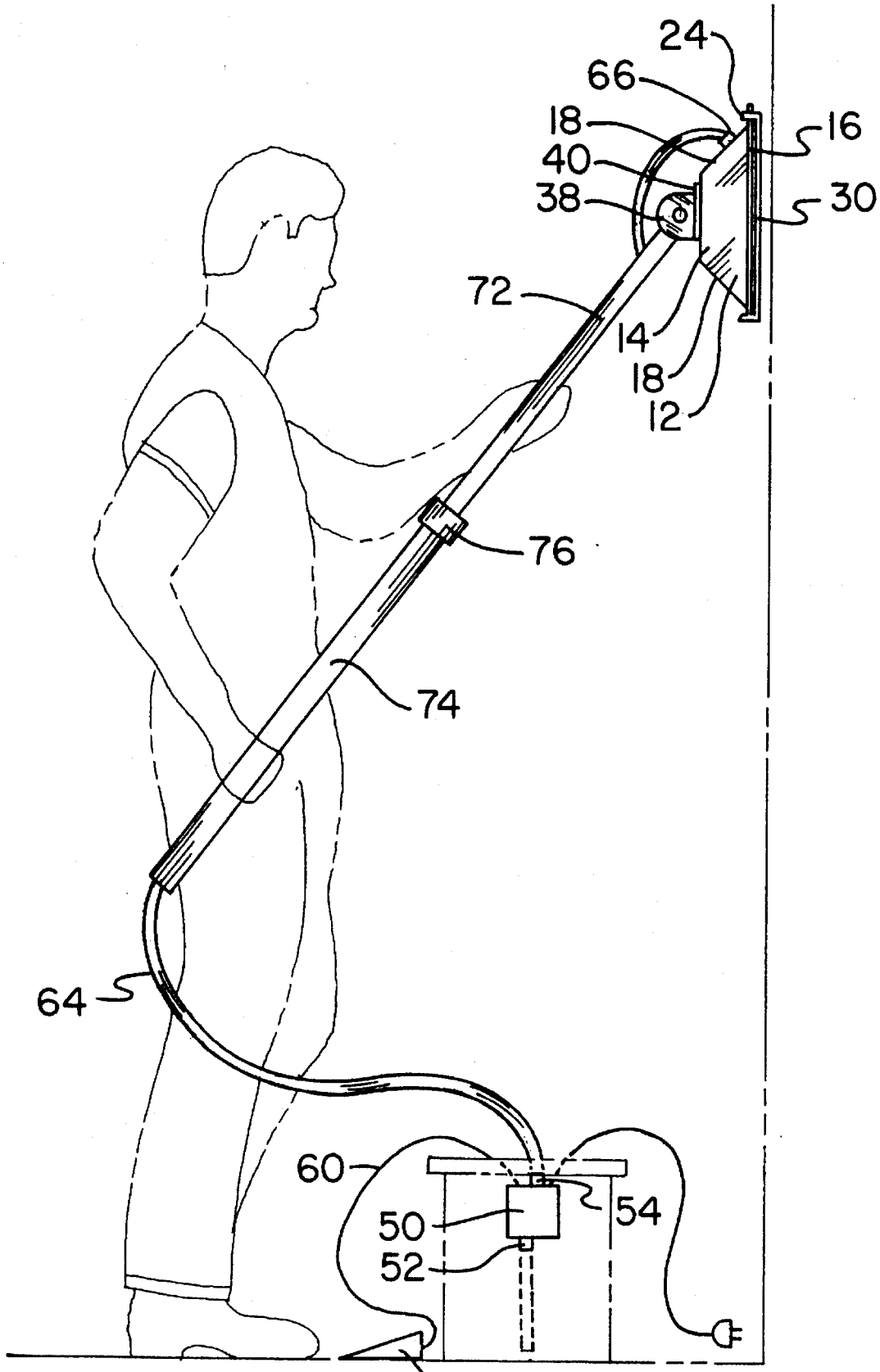
FIG. 1 is a perspective view of the preferred embodiment of the paint pad assembly with a pump supplied reservoir constructed in accordance with the principles of the present invention.
Figure 3:
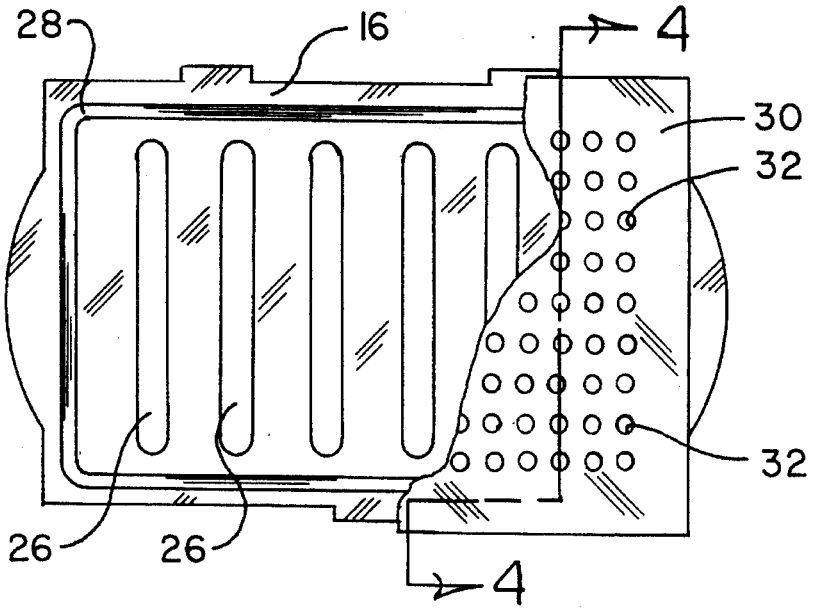
FIG. 3 is a broken away perspective view of the steel screen, rubber gasket and reservoir of the apparatus.
Figure 2:
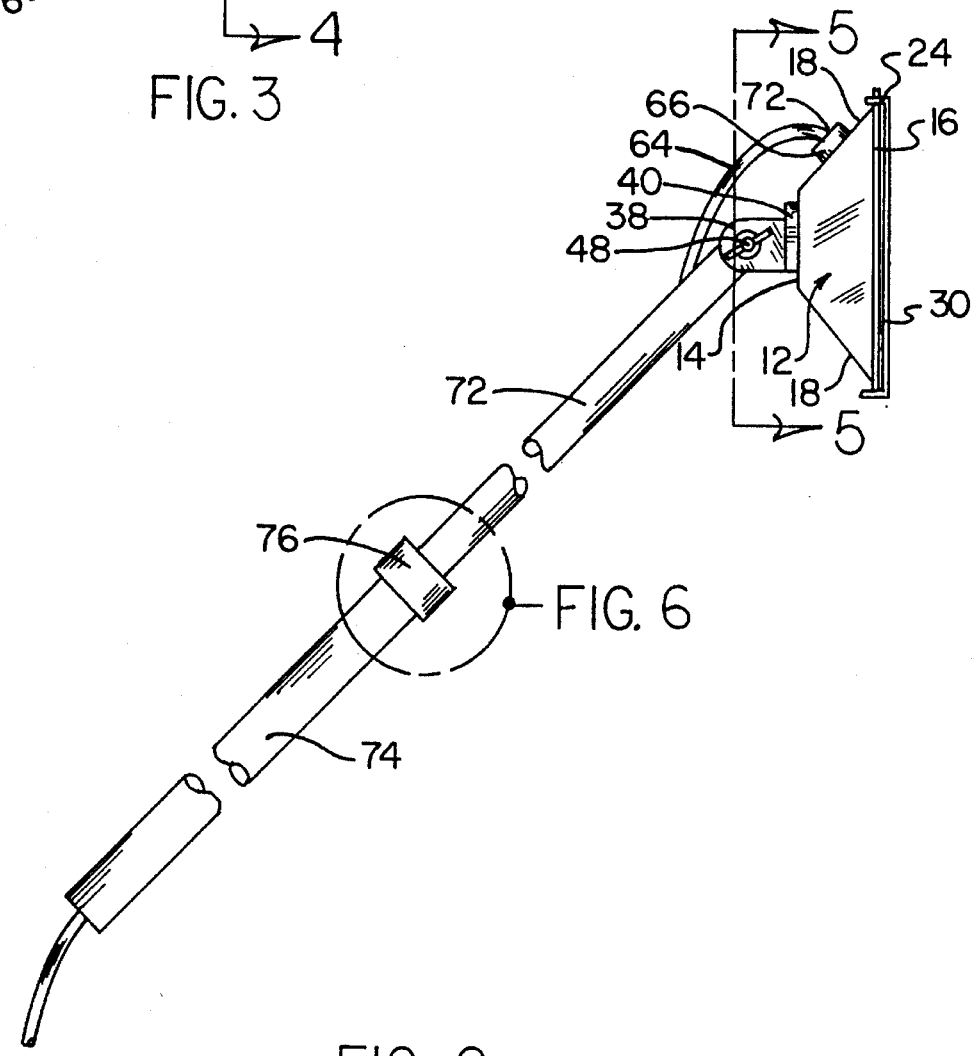
FIG. 2 is a broken away side perspective view of the apparatus shown in FIG. 1.
Figure 4:
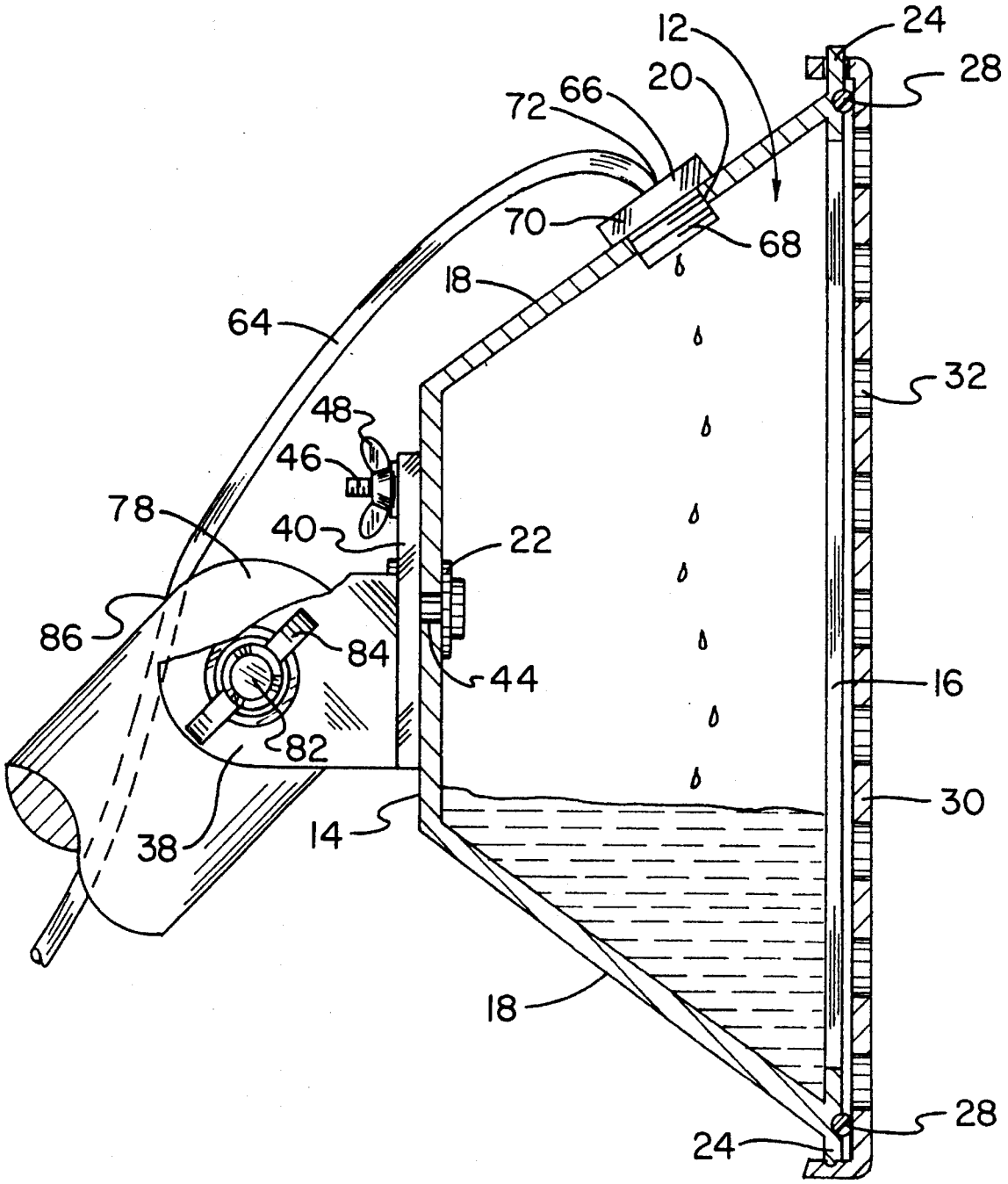
FIG. 4 is a broken away cross sectional view of the reservoir, mounting brace and handle taken along line 4—4 of FIG. 3.
Figure 5:
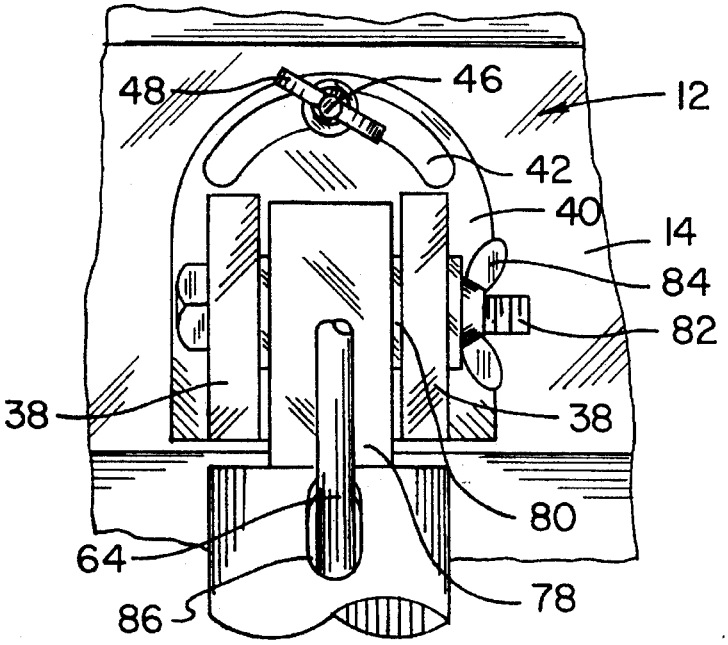
FIG. 5 is a broken away perspective view of the mounting brace, handle, and hose of the apparatus.
Figure 6:
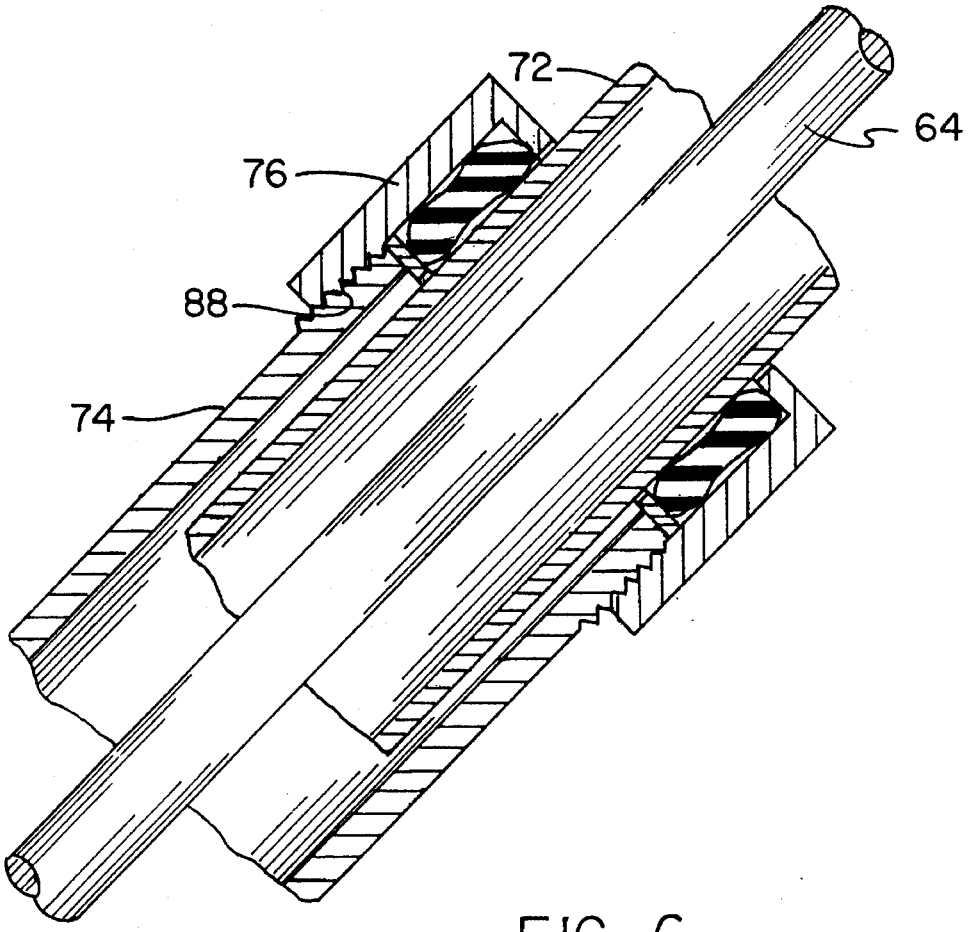
FIG. 6 is a broken away cross sectional view of both segments of the handle and the collar component, and further illustrating the hose positioned therein.

With reference now to the drawings, and in particular to FIG. 1 thereof, the preferred embodiment of the new and improved paint pad assemblies with a pump supplied reservoir embodying the principles and concepts of the present invention and generally designated by the reference numeral 10 will be described.

Specifically, it will be noted in FIGS. 1 through 6, that there is provided a new and improved paint pad assembly with a pump supplied reservoir. The paint pad assemblies with a pump supplied reservoir 10, in its broadest context, comprises a reservoir 12, a steel screen 30, a mounting brace 36, a submergible pump 50, a hose 64 and an extension handle 70.

More specifically, the reservoir 12 is formed as a generally rectangular shaped box with a small vertical back plate 14, a large vertical front plate 16 and four slanted pyramid shaped side plates 18 connecting the back and front plates therebetween. All of the plates have an internal surface and an external surface. The hollow interior of the reservoir serves as a temporary storage area for paint destined for application on a recipient surface. The reservoir 12 has a circular aperture with internal screw threads 20 positioned slightly below the midpoint of one of the side plates. Paint is received by the reservoir through the aperture. The back plate 14 includes coupling means 22 in the form of a planar nut which extends through the plate at its approximate center point. Note FIGS. 2 and 4 in particular.

The four side edges of the front plate 16 include coupling means 24 to permit releasable coupling with the lower extents of the side plates 18. The ability to remove the front face aids the user in cleaning the interior of the reservoir. The outer perimeter of all four sides of the front plate extend a small distance outward from the intersection point of the front 16 and side plates 18. This configuration permits the user to attach a wide variety of painting accessories to the apparatus. The front plate 16 includes a plurality of long generally rectangular shaped apertures 26 throughout its surface to permit the free flow of paint therethrough. Note FIG. 4 in particular.

The reservoir 12 includes a rubber gasket 28 formed as a generally rectangular shaped band. The gasket 28 is affixed around the side edges of the external surface of the front plate 16 of the reservoir. The gasket is adapted to help prevent leakage of paint when utilizing the apparatus. Note FIGS. 3 and 4.

A steel screen 30 is formed in a generally planar rectangular configuration with a plurality of small circular holes 32 throughout its surface. The screen 30 includes coupling means around its periphery to permit coupling to the front plate 18. The screen attaches quite easily to the extended edges of the front face. The screen 30 is adapted to allow the free flow of paint therethrough and onto a desired recipient surface. The plurality of holes in the screen helps to insure a consistent flow of paint from the reservoir. Note FIGS. 3 and 4.

A mounting brace 36 has an upper region 38 and a lower region 40. The lower region 40 is formed as a generally planar semi circular shaped plate with a rounded end and a linear end. A long semi circular shaped aperture 42 is positioned near the rounded portion of the plate and follows its contour. The plate 40 is affixed to the outer surface of the back plate by coupling means 44 located at the center point of the plate to permit circular rotation thereabout. The coupling means permit a user to rotate the reservoir to aid access to difficult to reach ares such as corners of walls and ceilings. The back plate 14 includes a screw 46 which extends upwardly through the semi circular aperture 42. A wing nut 48 is cooperatively coupled to the screw 46 to hold the plate 40 securely in place, while also permitting alternative positioning of the plate by swiveling it about the aperture 42. To change the position the user simply loosens the wing nut, moves the brace and retightens the wing nut. Note FIG. 5 in particular.

The upper region 38 of the brace includes two oppositely opposed, upwardly extending, generally semi circular shaped members positioned perpendicular to the linear end of the plate 40. The members are separated by a small distance and include centrally located circular holes at their approximate center points. Note FIGS. 2 and 5.

A submergible pump 50 includes an intake pipe 52 for the receipt of paint, an output pipe 54 for the distribution of paint, and an electrically powered motor 56 positioned therebetween. The pump includes a foot pedal 58 positioned outside of the paint supply. The pedal 58 is coupled to the motor by an electrical wire 60. The pedal 58 is adapted to permit a user to regulate the flow of paint distributed by the pump 50 by depressing the pedal 58. The flow of paint is terminated upon release of the pedal 58 by the user. The pump 50 is adapted to be submerged in a supply of paint in the operative orientation. The pump forces the paint through the hose and into the reservoir when the user depresses the foot pedal. This system provides an efficient method of ensuring that only the desired amount of paint is applied to particular surface. Note FIG. 1.

A hose 64 is comprised of flexible materials and formed in a long hollow, tubular configuration with two free ends. The hose 64 is cooperatively coupled with a cap 66 formed in a generally solid cylindrical configuration. The cap 66 includes external screw threads 68 and a planar circular top section 70. The cap 66 has a centrally located circular hole 72 which extends therethrough. One free end of the hose 64 is affixed within the hole in the cap. The cap 66 is coupled within the circular aperture 20 in the side plate of the reservoir. Paint is delivered into the reservoir through the hose in the cap. After use the cap is easily removed to aid in cleaning of the apparatus. The other free end of the hose 64 is coupled to the output pipe 54 of the submergible pump 50 which is positionable in a supply of paint in the operative orientation. Note FIGS. 1 and 4.

An extension handle 70 has an upper segment 72 and a lower segment 74. The upper segment 72 is formed as an elongated hollow tubular member with an open end at its lowermost extent. A cylindrical collar 76 with internal screw threads is positioned a short distance below the open end. The collar 76 is adapted to allow movement of the upper segment 72 through the opening in the collar 76. The collar functions to hold the two segments together. The upper segment 72 includes a generally planar semi circular piece 78 at its uppermost extent. The piece 78 includes a centrally located screw hole 80 and is adapted to be positioned between the upwardly extending members of the mounting brace 36. A bolt 82 and wing nut 84 are adapted to couple the upper segment 72 of the handle to the members through their aligned screw holes. The adjustable nature of the bolt and wing nut permit the user to change the angle to which the handle attaches to the reservoir. This allows the user to paint walls and ceilings of varying heights. The upper segment 72 also includes a circular hole 86 near its uppermost extent. This hole is adapted to permit passage of the hose therethrough in the operative orientation.

The lower segment 74 is formed as an elongated hollow tubular member with a larger circumference than the upper segment 72. The lower segment 74 has an open end at its lowermost extent, with the uppermost extent including an open end and external screw threads 88. The open ends are adapted to allow for the passage of a hose therethrough in the operative orientation. The uppermost extent of the lower segment 74 is adapted to be releasably coupled with the collar 76 of the upper segment 72. The lower segment 74 is also adapted to receive the upper segment 72 and lock the handle to the desired length upon twisting of the segments. Since the upper segment may be telescopically received by the lower segment, the user is permitted to adjust the handle to a plurality of lengths. The hose 64 is positioned through the open end in the lowermost extent of the lower segment and circular hole 86 in the upper segment. The hollow interior of the extension handle houses the hose therebetween. The position of the hose within the handle also serves to prevent excessive tangling of the hose. Note FIGS. 2, 5 and 6.

A painter's arsenal includes three tools: a brush, roller, and pad. Each of these tools is effective in different situations. The painter may use the brush to paint a door, the roller to paint a ceiling, and the pad to paint elsewhere. Many novice painters try to paint walls with the roller, but this is not always effective for several reasons. It is difficult to reach the highest places without the aid of a ladder, especially in homes with ceilings above eight feet. It is troublesome (if not impossible) to get into corners with the roller or to avoid getting paint on the ceiling. For these reasons, painters often use a pad on walls. Since they are rectangular in shape and equipped with edge guards, painters can get in corners and along edges without splattering paint on the abutting surfaces.

The paint pad assembly with a pump supplied reservoir is a new type of painting device that comes with an extension handle to reach even the highest ceiling. The apparatus resembles the standard paint pad, but is designed to work in conjunction with commercial paint pumps. The apparatus includes a steel screen affixed to a standard paint pad. The paint travels through a series of small holes in the screen. An extension handle attaches to a rotatable mounting brace on the top of the reservoir of the apparatus. Two wing nuts enable users to tighten or loosen the handle as they require. The handle is hollow with a hose threaded through the center. The hose is coupled inside the reservoir through a circular aperture.

Painters insert the hose from the extension handle into the submersible pump within the paint source. The pump is then turned on and paint is pumped through the hose and into the reservoir of the apparatus. Paint is dispensed through the holes in the reservoir and screen. Painters can reach high corners by extending the extension handle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved paint pad assembly with a pump supplied reservoir comprising, in combination:

a reservoir formed as a generally rectangular shaped box with a small vertical back plate, a large vertical front plate and four slanted pyramid shaped side plates connecting the back and front plates therebetween, all plates having an internal surface and an external surface, the reservoir having a circular aperture with internal screw threads positioned slightly below the midpoint of one of the side plates, the back plate including coupling means extending through the plate at its approximate center point, the four side edges of the front plate including coupling means to permit releasable coupling with the lower extents of the side plates, with the outer perimeter of all four sides of the front plate extending a small distance outward from the intersection point of the front and side plates, the front plate including a plurality of long generally rectangular shaped apertures throughout its surface to permit the free flow of paint therethrough, the reservoir including a rubber gasket formed as a generally rectangular shaped band, the gasket being affixed around the side edges of the external surface of the front plate of the reservoir, the gasket adapted to help prevent leakage of paint;

a steel screen formed in a generally planar rectangular configuration with a plurality of small circular holes throughout its surface, the screen including coupling means around its periphery to permit coupling to the front plate, the screen adapted to allow the free flow of paint therethrough and onto a desired recipient surface;

a mounting brace, the brace having an upper region and a lower region, the lower region formed as a generally planar semicircular shaped plate with a rounded end and a linear end, a semi circular shaped aperture being positioned near the rounded portion of the plate and following its contour, the plate being affixed to the outer surface of the back plate by coupling means at the center point of the plate to permit circular rotation thereabout, the back plate having a screw extending upwardly therefrom through the semi circular aperture, a wing nut being cooperatively coupled to the screw to hold the plate securely in place while also permitting alternative positioning by swiveling the plate about the aperture, the upper region of the brace including two oppositely opposed upwardly extending generally semi circular shaped members positioned perpendicular to the linear end of the plate, the members being separated by a small distance and including centrally located circular holes at their approximate center points;

a submergible pump, the pump including an intake pipe for the receipt of paint, an output pipe for the distribution of paint, and an electrically powered motor positioned therebetween, the pump including a foot pedal positioned outside of the paint supply, the pedal being coupled to the motor by an electrical wire, the pedal adapted to permit a user to regulate the flow of paint distributed by the pump by depressing the pedal, the flow of paint being terminated upon release of the pedal by the user, with the pump adapted to be submerged in supply of paint in the operative orientation;

a hose, the hose being comprised of flexible materials and formed in a long hollow tubular configuration with two free ends, the hose being cooperatively coupled with a cap formed in a generally solid cylindrical configuration with external screw threads and a planar circular top section, the cap including a centrally located circular hole extending therethrough, one free end of the hose being affixed within the hole in the cap, with the cap being coupled within the circular aperture in the side plate of the reservoir, with the other free end of the hose being coupled to the output pipe of the submergible pump positionable in a supply of paint in the operative orientation; and an extension handle, the handle having an upper segment and a lower segment, the upper segment formed as an elongated hollow tubular member with an open end at its lowermost extent, a cylindrical collar with internal screw threads being positioned a short distance below the open end, the collar adapted to allow movement of the upper segment through the opening in the collar, the upper segment including a generally planar semi circular piece at its uppermost extent, the piece including a centrally located screw hole and adapted to be positioned between the upwardly extending members of the mounting brace, a bolt and wing nut being adapted to couple the upper segment of the handle to the members through their aligned screw holes, the upper segment also including a circular hole near its uppermost extent, the lower segment being formed as an elongated hollow tubular member with a larger circumference than the upper segment and having an open end at its lowermost extent, with the uppermost extent including an open end and external screw threads, the uppermost extent of the lower segment adapted to be releasably coupled with the collar of the upper segment, the lower segment also adapted to receive the upper segment and lock the handle to the desired length upon twisting, the hose being positioned through the open end in the lowermost extent in the lower segment and circular hole in the upper segment, with the hollow interior of the extension handle housing the hose therebetween.

2. A paint pad assembly with a pump supplied reservoir comprising:

a reservoir formed as a generally rectangular shaped box with a vertical back plate, a vertical front plate and four side plates therebetween, one of the side plates including an aperture, the front plate including coupling means to permit releasable coupling with the side plates, the front plate including a plurality of long generally rectangular shaped apertures to permit the free flow of paint therethrough;

two upwardly extending brackets separated by a small distance, with each bracket having an aperture including coupling means, the brackets being positioned on the back face of the reservoir;

a hose comprised of flexible materials and formed in a long hollow tubular configuration with two free ends, one end of the hose being coupled to the reservoir through the aperture in the side wall, with the other free end being coupled to a paint supply; and a handle formed as an elongated hollow tubular member with an open end at its lowermost extent, the handle including an aperture near its uppermost extent with a circular hole positioned a short distance below the aperture, the handle being coupled to the brackets on the reservoir through the aligned apertures, the hose being positioned through the open end in the lowermost extent and circular hole near the uppermost extent, with the hollow interior of the handle housing the hose therebetween, a paint supply to replenish the reservoir including a submergible pump with an intake pipe for the receipt of paint, an output pipe for the distribution of paint, and a motor positioned therebetween, the paint supply including a receptacle containing paint, the pump being submerged in the paint in the operative orientation.

3. The apparatus as set forth in claim 2 wherein the reservoir includes a gasket formed as a generally rectangular shaped band, the gasket being affixed around the side edges of the front plate of the reservoir; and a screen formed in a generally planar rectangular configuration with a plurality of small circular holes throughout its surface, the screen including coupling means around its periphery to permit coupling to the edges of the front plate.

4. The apparatus as set forth in claim 2 wherein the handle consists of a plurality of hollow segments of increasing diameter, the handle adapted to adjust to differing lengths by extending or retracting the segments within one another in a telescopic orientation.

5. The apparatus as set forth in claim 2 wherein the brackets on the back plate are adapted to permit vertical and horizontal rotation of the handle.

* * * * *